US005492153A

United States Patent [19]

Stacher et al.

[11] Patent Number: 5,492,153

[45] Date of Patent: Feb. 20, 1996

[54] CLAMP TYPE ARRANGEMENT FOR PRESENTING WEFT THREADS TO A GRIPPER

[75] Inventors: Angelo Stacher, Arbon; Theo Thalmann, St. Gallen, both of Switzerland

[73] Assignee: Sulzer Rueti AG, Rueti, Switzerland

[21] Appl. No.: 289,824

[22] Filed: Aug. 12, 1994

[30] Foreign Application Priority Data

Sep. 20, 1993 [EP] European Pat. Off. ..... 93810659

[51] Int. Cl.[6] ..... D03D 47/38

[52] U.S. Cl. ..... 139/453; 66/146; 242/150 R; 139/450

[58] Field of Search ..... 139/453, 450; 66/146; 242/150 R, 149

[56] References Cited

U.S. PATENT DOCUMENTS

| | | | |
|---|---|---|---|
| 3,921,678 | 11/1975 | Palencher . | |
| 4,185,667 | 1/1980 | Kendrick | 139/453 X |
| 4,840,203 | 6/1989 | Moeneclaey et al. | 139/453 |
| 4,913,195 | 4/1990 | Speich | 139/450 |
| 5,090,457 | 2/1992 | Corain et al. | 139/453 |
| 5,156,105 | 10/1992 | Wang | 242/150 R |
| 5,345,790 | 9/1994 | Schouten | 66/146 |

FOREIGN PATENT DOCUMENTS

| | | | |
|---|---|---|---|
| 0240075 | 9/1992 | European Pat. Off. | 139/453 |
| 389610 | 2/1924 | Germany . | |

*Primary Examiner*—Andy Falik

*Attorney, Agent, or Firm*—Townsend and Townsend and Crew

[57] ABSTRACT

A weft yarn presentation apparatus has a weft sequence control having weft thread presenting devices (1), a controlled thread clamping device (2) with several clamps (3*a*–3*f*) and a guide member (4) with a slit (5). The association of the weft thread presenting devices (1) with the clamps (3*a*– 3*f*) guarantees that there is no cross-over of the tracks of the weft threads, and the displacement of the clamps in the reference plane (6) does not influence these tracks. The weft thread is presented to the gripper in the reference plane (6), through matching of the movements of the clamp and of the associated weft thread presenting device (1) so that contact between the weft threads is prevented.

17 Claims, 5 Drawing Sheets

5
4
15
14
27
13
23
26
22
24
17
11
21
12
16
14
15

CLAMP TYPE ARRANGEMENT FOR PRESENTING WEFT THREADS TO A GRIPPER

BACKGROUND OF THE INVENTION

The invention concerns an arrangement for the presenting of weft threads in a rapier weaving machine, and a rapier weaving machine having such an arrangement.

In EP-A-421 394, an apparatus is described which has two clamping positions. After the delivery of the weft thread to the rapier weaving-machine, the appropriate clamping position is made ready for the taking-up of the inserted weft thread in the manner of a weft selector and finally clamps the weft thread, with the clamping positions being arranged above and below the cloth plane. There is provided a first guide member having a slit through which the weft threads are guided from the weft thread presenting devices to the clamping positions. Due to the fact that the weft threads are guided in the same plane but are clamped at different levels on both sides of this plane, contact between the weft threads and crossing-over of the weft threads occurs in the slit and in the tracks of the weft threads between the clamping positions and the weft thread presenting devices respectively. This is a disadvantage. In one embodiment of the apparatus, the end of the slit is widened to prevent of the weft thread from being pulled along. When the presented weft thread is taken over by the gripper, the thread is stretched over the edge formed by the widened portion, which can lead to breakage of the weft thread. Apart from this, the tracks of the weft threads can cross. These are further disadvantages.

For the presenting of a plurality of weft threads, for example, of four weft threads, two such devices are provided. The devices are arranged in an upper and lower position and each is movable up and down in order to displace the respective device into a presenting position. The time-interval between two weft thread presenting procedures is thereby increased, in particular due to the displacement of the device, so that the working speed and the number of presented weft threads is undesirably restricted. Since every device comprises a thread guide, the weft threads in each device are shifted with respect to the weaving plane such that each thread has an excess length which can lead to a crossing-over of the weft threads. In particular, loops occur with metal thread composite material in the form of bands (Lurex), highly spun crepe yarns, microfibers, etc.

Since the two devices work according to the principle of a weft selector, the apparatus for presenting a plurality of weft threads is expensive and the space required is large, which represents a further disadvantage.

SUMMARY OF THE INVENTION

Here, the invention provides a remedy by providing an arrangement for presenting weft threads so that a selective presentation of the weft threads at a higher working speed of the weaving machine is guaranteed while avoiding the above-mentioned disadvantages. The required space for the presenting the weft thread to be inserted is thereby restricted to a minimum.

Since the association of the weft thread presenting devices with the clamping position guarantees cross-over free tracks for the weft threads, and the displacement of the clamping positions into the reference plane does not influence these tracks, the weft thread is presented to the gripper in the reference plane by a matching of the movements of the clamping position and of the associated weft thread presenting device. This has the advantage that the clamping position is adjusted into the reference plane prior to the weft thread presenting device in order to displace the weft thread into the slit of the guide member and to prevent a contact between the weft threads.

It is advantageous when the pitch or spacing of the clamping positions amounts to at least 1 mm and when a positioning device in the form of a stepping motor is used. Through this, the positioning times can be shortened, so that at high working speeds of the weaving machine six and more weft threads can be presented.

In the following, the invention will be explained with reference to the enclosed drawings.

DESCRIPTION OF THE PREFERRED EMBODIMENTS

Figure 1:
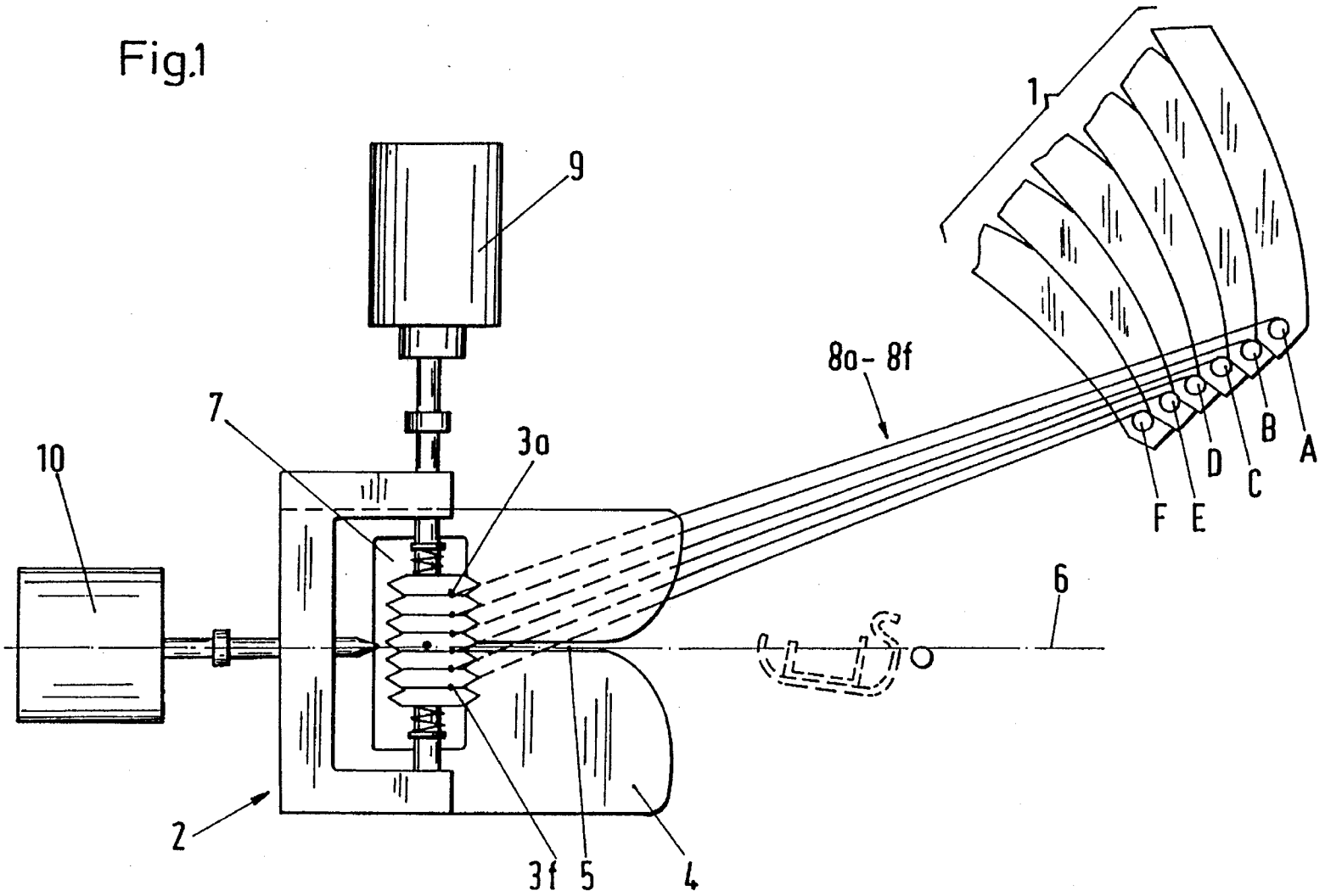
FIG. 1 is a partial, elevational view of a device constructed in accordance with the invention for sequentially presenting three or more weft threads for picking and taking-up during weaving on a rapier loom.

The arrangement shown in FIG. 1 includes a picking or weft sequence control (not shown) having six weft thread presenting devices 1, a controlled thread assembly 2 having six openable clamps or clamping positions 3*a* to 3*f*, each defined by a pair of cooperating clamping bodies 12 (see FIG. 2), and a guide member 4 with a slit 5. The arrangement is assembled in a rapier weaving machine such that the clamps or clamping positions lie above one another with respect to the weaving plane, which, in the following, is identified as reference plane 6, and the slit 5 is arranged in the reference plane 6. The guide member 4 includes a recess 7 into which the slit 5 opens.

The weft thread presenting devices 1 are staggered such that the guide openings A to F have different heights with respect to the reference plane 6. With the arrangement, six weft threads 8*a* to 8*f* are presented. Each weft thread presenting device 1 is associated with one clamp 3*a* to 3*f* in such a way that each weft thread is led substantially parallel and free of cross-over from the clamps holding the weft thread through the recess to guide openings A to F. Further, there is provided a positioning device 9 in order to displace the clamps 3*a* to 3*f* with respect to the reference plane 6, and a device 10 for holding a selected clamp open. The positioning device 9 is a stepping motor having a control device, not shown, and is connected with the loom and driven by an appropriate weaving program. The device 10 is, for example, an electromagnet which is driven from the weft thread sequence control. It is pointed out that instead of the magnet, a lever arrangement can be provided which is connected with the weft thread sequence control.

Figure 2:
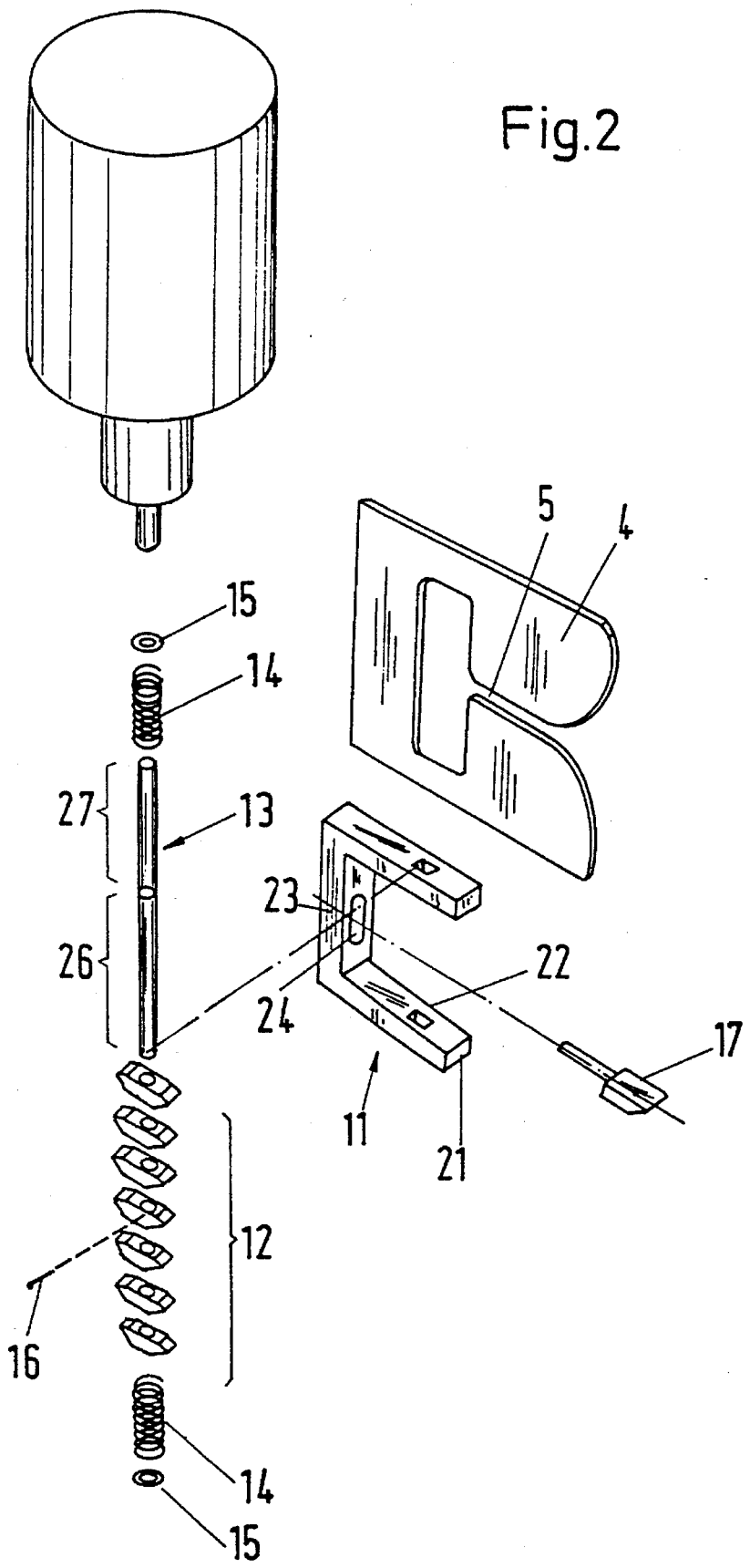
FIG. 2 is an exploded view of a preferred embodiment of a thread clamp used in the device shown in FIG. 1.

As shown in FIG. 2, the thread clamp assembly 2 comprises a holder 11, seven clamping bodies 12, each adjacent two of which define the earlier-mentioned six clamps or clamping positions 3*a* to 3*f* a positioning member 13, two pressure springs 14, two retaining rings or circlips 15, a pin 16 and an opening member 17.

The holder 11 is U-shaped and has in each of its limbs 21 a through hole 22 having a square cross-section and in its base section 23 an elongate hole 24. The clamping bodies 12 have substantially the shape of a parallelepiped and have a through-hole 25 having a square cross-section. The ends of the clamping bodies are wedge-shaped in order to facilitate the introduction of the weft thread and of the opening member 17. The positioning member 13 is rod-shaped and has a section 26 of square cross-section and a second section 27 of round cross-section.

Figure 3:
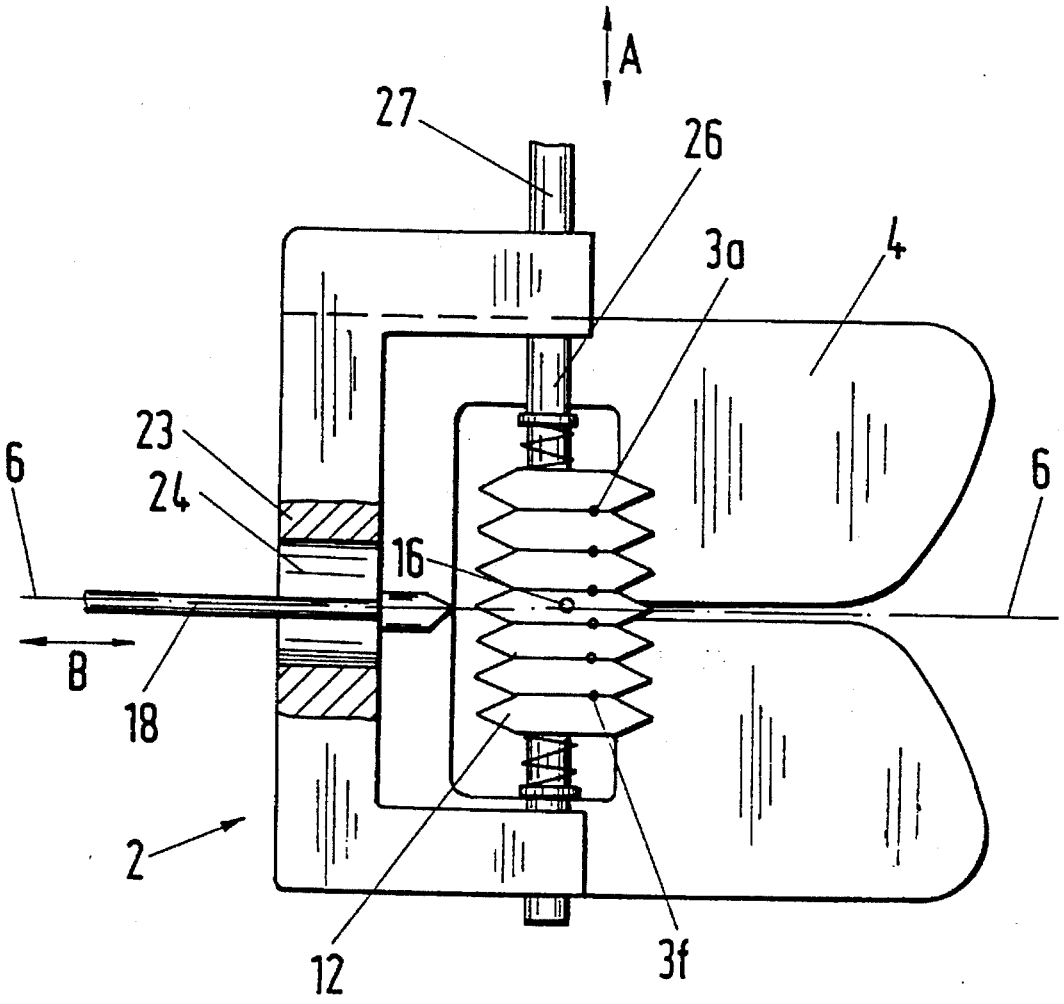
FIG. 3 shows a thread clamp according to FIG. 2 installed on a rapier loom.

FIG. 3 shows the thread clamp in the installed condition without the positioning device 9 and the device 10. The positioning member 13 is movably arranged in the limbs 21 in the direction of the double arrow A. Seven clamping bodies 12 which form the six clamps 3*a* to 3*f* are arranged on the first section 26. The clamping bodies are laid out so that the clamps or clamping positions have a spacing of, for example, 3 mm. The middle clamping body is firmly connected with the adjusting member 13 by the pin 16 and three clamping bodies are movably arranged on each side of the fixed clamping body. Compression springs 14 are arranged on both sides of the clamping bodies 12 and contact the retaining rings 15 at one end and the outer clamping bodies 12 at the other end while pressing the latter towards one another. The positioning member 13 is connected with the positioning device 9. The opening member 17 is displaceably arranged in the elongate hole 24 in the direction of the double arrow B and is connected with the device 10.

Figure 4:
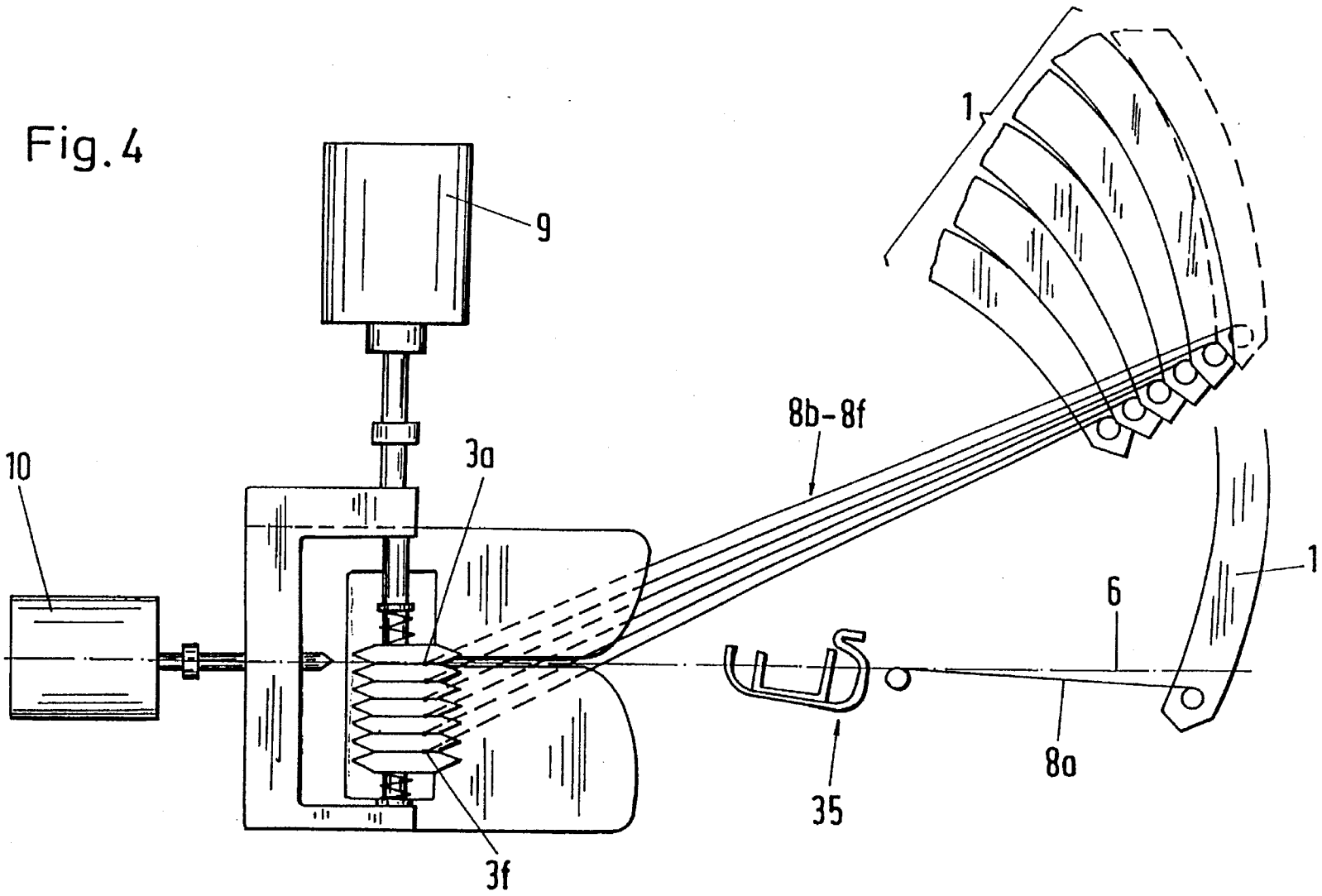
FIG. 4 illustrates the device of FIG. 1 in its operating position when presenting a weft thread.
Figure 5:
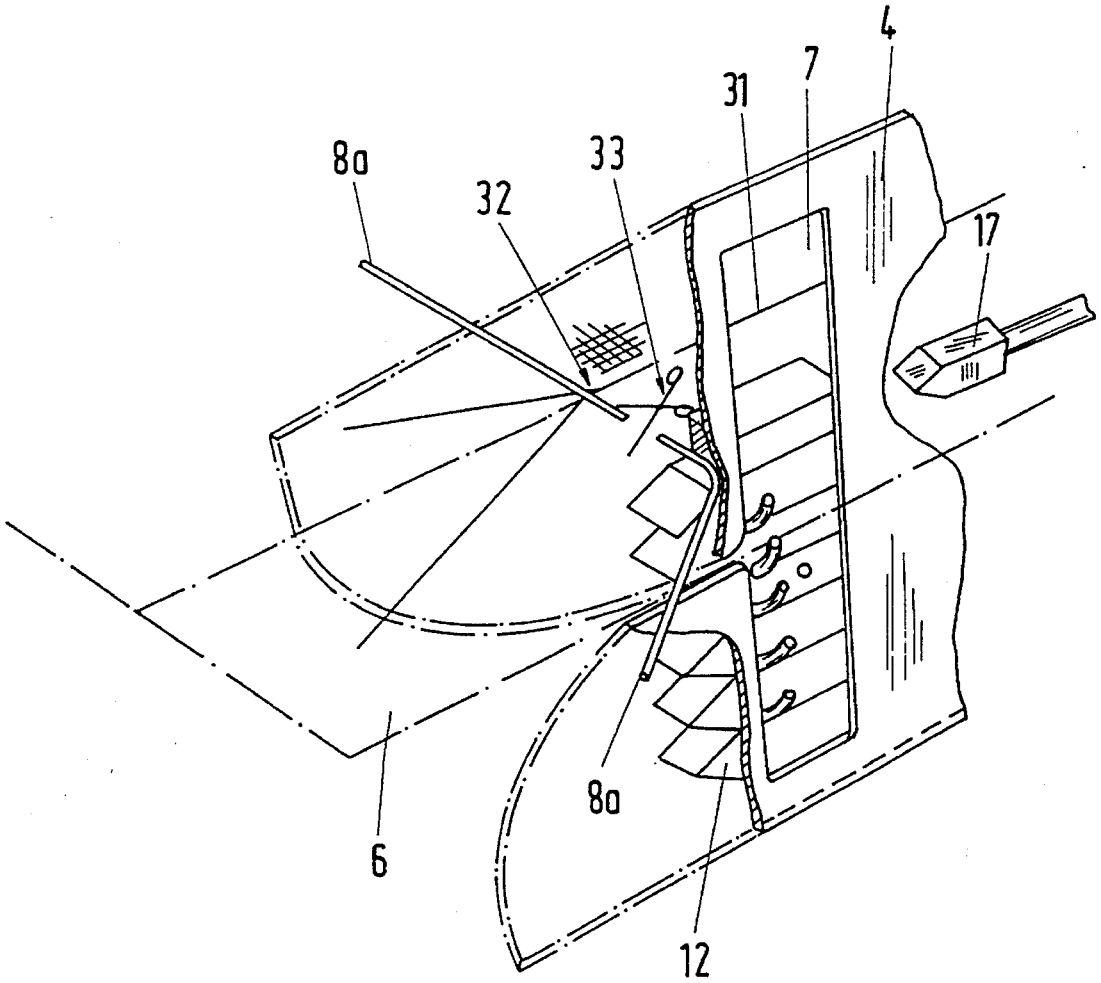
FIG. 5 is an elevational view, with parts broken away, corresponding to FIG. 4 seen from the direction of the weft thread presenting device.

Reference is made to FIGS. 4 and 5, FIG. 4 showing the arrangement from the weaving position side and FIG. 5 showing it from the opposite side. The thread clamp assembly and the guide member 4 are connected with each other and form a functional unit. This functional unit is mounted in the rapier weaving machine by way of means not shown. The thread clamp 2 is arranged at a predetermined distance with respect to the cloth edge 31 so that the clamping positions 3 are respectively aligned with the apex of the shed or cloth fell 32. A cutting apparatus 33 is arranged (FIG. 5) between the thread clamp 2 and the cloth edge 31.

In the following, the manner in which the arrangement functions is described, with the arrangement being brought from the position shown in FIG. 1 into the position shown in FIG. 4 in which the weft thread 8*a* is presented to the gripper 35. The presenting of the weft thread occurs in two stages, namely swinging the weft thread presenting device 1 in the direction of the reference plane 6 and displacing the clamping position 3*a* into the reference plane 6. As mentioned before, the weft threads 8*a* to 8*f* are led without any cross-over between the clamping positions and the guide openings. This condition is retained on pivoting of the weft thread presenting device. On the other hand the displacement of the clamping position 3*a* into the reference plane 6 ensures that the weft thread 8*a* is arranged in the reference plane 6 and is already inserted into the slit 5 as a result of the pull acting on the thread as can be seen in FIG 5. Due to this spatial separation of the weft thread 8*a* from the other weft threads, no contact occurs between them when the weft thread is taken over by the gripper 35. After the taking-over of the weft thread 8*a* by the gripper 35, the end of the weft thread is peeled out from the clamping position 3*a* and drawn into the weaving shed. During the drawing-in of the weft thread 8*a*, opening member 17 holds the clamp 3*a* open by the introduction of the member between the clamping bodies 12 which form clamp 3*a*. Thus, the opening member simultaneously forms a gap between the clamping bodies 12. The drawn-in weft thread 8*a* is introduced into this gap again during the beat-up by the reed (not shown). Before the beat-up of the weft thread 8*a*, the weft thread presenting device 1 is located back in the position shown by the dashed line. During the beat-up, the weft thread 8*a* is led through the run-in gap into the slit 5 whereby the weft thread 8*a* is guided at the upper side of the slit 5 due to the position of the weft thread presenting device 1. In this way, the weft thread is introduced spatially separated from the other weft threads into the gap between the clamping bodies 12. By pulling back the opening member 17, the clamp is again closed as a result of the spring force and the weft thread is held in the clamp. Finally, the picked weft thread is cut by means of the cutting device 33. In this way, the weft thread is made ready for a new insertion.

What is claimed is:

1. Apparatus for presenting weft threads for weaving on a rapier weaving machine comprising means for controlling the weft thread sequence including at least three weft thread presenting devices; a movably mounted weft thread clamp assembly having at least three weft thread clamps which are spaced apart in the direction of movement of the clamp assembly, means for moving each of the weft thread clamps into a reference plane, the clamps being spaced from the weft thread presenting devices and each clamp being associated and cooperating with a corresponding one of the weft thread presenting devices, the clamps and the weft thread presenting devices being arranged so that the weft threads extending between them are substantially parallel and do not cross each other; and a guide member which is stationary relative to and located proximate the thread clamp assembly and which has a slit aligned with the reference plane; whereby the clamp presents the weft threads for gripping without contacting each other.

2. Apparatus according to claim 1 including a positioning device for moving the clamp assembly and positioning any one of the clamps in the reference plane to thereby ready the weft thread in the clamp in the reference plane for gripping.

3. Apparatus according to claim 2 wherein the positioning device comprises a stepping motor.

4. Apparatus according to claim 1 including an opening member mounted in the reference plane and movable to open the clamp in the reference plane to thereby permit a taking-up of the weft thread in the open clamp.

5. Apparatus according to claim 4 wherein the opening member is mounted in the reference plane.

6. Apparatus according to claim 4 including power-driven means for moving the opening member.

7. Apparatus according to claim 1 wherein the thread clamp assembly includes a fixed holder, a positioning member movably mounted on the holder, and clamping bodies carried by the positioning member and defining the clamps, the positioning member including means for moving the clamping bodies and therewith the clamps into the reference plane.

8. Apparatus according to claim 7 including means for immovably mounting at least one of the clamping bodies on the positioning member.

9. Apparatus according to claim 7 including an opening member movably mounted to the holder and positioned so that it can be moved between the two clamping bodies defining the clamp in the reference plane, the opening member including means for separating said two clamping bodies and thereby opening the corresponding clamp.

10. Apparatus according to claim 1 including means forming a spacing between the clamps of at least 1 mm.

11. Apparatus according to claim 1 wherein the guide member is fixably mounted relative to the reference plane to facilitate the gripping and taking-up of the weft thread in the reference plane.

12. Apparatus according to claim 11 wherein the guide member includes a recess shaped so that the clamps are arranged and displaceable within an outline of the recess so that the weft threads can extend without contacting each other from the weft thread presenting devices to the clamps, and wherein the slit of the guide member communicates with the recess for presenting the weft threads for gripping.

13. Apparatus according to claim 1 including means for forming a spacing between the clamps which is constant.

14. Apparatus according to claim 1 including means for reciprocably moving the weft thread clamp assembly.

15. Apparatus according to claim 1 including means for moving the thread presenting devices between first and second respective positions in which the corresponding weft threads are relatively removed form and proximate to the reference plane.

16. Apparatus according to claim 15 including means for pivotally moving the weft thread presenting devices between their first and second positions.

17. A rapier weaving machine comprising means for controlling a sequence of weft threads including at least three weft thread presenting devices; a movably mounted weft thread clamp assembly having at least three weft thread clamps which are spaced apart in the direction of movement of the clamp assembly, means for moving each weft thread clamp into a weaving plane, the clamps being spaced from the weft thread presenting devices and each clamp being associated and cooperating with a corresponding one of the weft thread presenting devices, the clamps and the weft thread presenting devices being arranged so that the weft threads extending between them are substantially parallel and do not cross each other; and a guide member for the weft threads located proximate the thread clamp and having a slit aligned with the weaving plane; whereby the clamp presents the weft threads for gripping and contact between the weft threads is prevented.

* * * * *